US006691747B1

(12) United States Patent
Marcus et al.

(10) Patent No.: US 6,691,747 B1
(45) Date of Patent: Feb. 17, 2004

(54) METHOD AND APPARATUS FOR EXPOSING A CONTAINER TO A CONTROLLED ENVIRONMENT

(75) Inventors: Frank F. Marcus, Lake in the Hills, IL (US); James J. Sanfilippo, Barrington Hills, IL (US); John E. Sanfilippo, Barrington Hills, IL (US)

(73) Assignee: MAP Systems International division of Jescorp, Inc., Des Plaines, IL (US)

( * ) Notice: Subject to any disclaimer, the term of this patent is extended or adjusted under 35 U.S.C. 154(b) by 194 days.

(21) Appl. No.: 09/616,186

(22) Filed: Jul. 14, 2000

(51) Int. Cl.[7] ..... B65B 31/00; B67C 3/00

(52) U.S. Cl. ..... 141/7; 141/4; 141/5; 141/48; 141/54; 141/56; 141/85; 141/89; 141/91; 141/92

(58) Field of Search ..... 141/4–7, 11, 37, 141/48, 54, 56, 69, 70, 85, 89, 91, 92, 129, 163, 181, 192, 234–237; 53/403, 425, 426, 167; 422/28, 1, 7, 302, 304

(56) References Cited

U.S. PATENT DOCUMENTS

| | | | | |
|---|---|---|---|---|
| 4,707,334 A | * | 11/1987 | Gerhard | 422/28 |
| 5,178,841 A | * | 1/1993 | Vokins et al. | 422/298 |
| 5,368,828 A | * | 11/1994 | Carlson | 422/300 |
| 6,120,730 A | * | 9/2000 | Palaniappan et al. | 422/28 |

* cited by examiner

*Primary Examiner*—Timothy L. Maust
(74) *Attorney, Agent, or Firm*—Cardinal Law Group

(57) ABSTRACT

An apparatus for exposing a container traveling along a conveyor to a controlled environment is provided. The apparatus includes an elongated rail and a first elongated gas deflecting member. The elongated rail includes a longitudinally oriented manifold. The longitudinally oriented manifold is adapted to align with a path of the container. The elongated rail also includes at least one inlet opening to receive a controlled environment gas. The first elongated gas deflecting member is positioned adjacent to the manifold. The first elongated gas deflecting member is contoured to deflect a flow of the controlled environment gas exiting the manifold in a direction transverse to the path of the container and into the container.

22 Claims, 6 Drawing Sheets

INSET B
SEE INSET B
12
14
21
22
23
24
25
27
29
32
34
36
38
74
76
82
84
86
J
K
L
M
N
O
P
Q
R

METHOD AND APPARATUS FOR EXPOSING A CONTAINER TO A CONTROLLED ENVIRONMENT

FIELD OF THE INVENTION

The invention relates to improved apparatus and method for exposing product, including food product, semiconductors, medical products and any product that has an adverse reaction to air, to a controlled environment. More particularly, this invention relates to improved apparatus and process for replacing air in product and/or containers with a desired controlled environment, including inert gas, combinations of gases and other aromas, mists, moisture, etc.

BACKGROUND OF THE INVENTION

Various products including food product, semiconductor products, medical products, and any other product that has an adverse reaction to air, are packaged in a controlled environment. Various attempts have been made to efficiently package these products in controlled environments using vacuum and/or controlled environments.

Various food products, including bakery goods, meats, fruits, vegetables, etc. are packaged under atmospheric conditions. Many of these products are presented in supermarkets, for example, in cartons or cardboard containers with a plastic or cellophane wrap covering the product.

One problem with this type of packaging is that the goods have a minimum limited shelf life, which for many products is only several days to a week. With bakery goods for example, mold may begin to grow after a few days under atmospheric conditions. Such products obviously cannot be sold or consumed and must be discarded.

Another problem arises with respect to many fruits and vegetables, which continue to ripen and continue their metabolic process under atmospheric conditions. For example, within a few days a banana can become overripe and undesirable to the consumer.

The space available for gassing operations is often limited at many facilities. In general, existing controlled environment systems are often expensive, bulky, and require three phase power, and, accordingly are impractical for use at many of these facilities.

In an effort to alleviate these problems, various attempts have been made to package food in a controlled environment by injecting controlled environment directly into filled containers. A high velocity flow is often necessary to penetrate into the food product. In general, most of these attempts have proved unsuccessful. With bakery goods, for example, the high velocity jets can pull in air and re-contaminate the product, thereby failing to reduce the oxygen to levels that would prevent the normal onset of mold.

Various techniques for removing air in food filling processes are known in the art. Such processes are used, for example, in the packaging of nuts, coffee, powdered milk, cheese puffs, infant formula and various other dry foods. Typically, dry food containers are exposed to a controlled environment flush and/or vacuum for a period of time, subsequent to filling but prior to sealing. The product may also be flushed with a controlled environment prior to filling, or may be flushed after the filling process. When the oxygen has been substantially removed from the food contents therein, the containers are sealed, with or without vacuum. Various techniques are also known for replacing the atmosphere of packaged meat products with a modified atmosphere of carbon dioxide, oxygen and nitrogen, and/or other gases or mixtures of gases to extend shelf life.

A gas flushing apparatus for removing oxygen from food containers is disclosed in U.S. Pat. No. 4,140,159, issued to Domke. A conveyor belt carries the open top containers in a direction of movement directly below a gas flushing device. The gas flushing device supplies controlled environment to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of controlled environment blanketing followed by jet flushing can be repeated a number of times until sufficient oxygen has been removed from the containers, and from the food contents therein.

One aspect of the apparatus disclosed in Domke is that the flow of gas in a container is constantly changing. The high velocity streams are directed through perpendicular openings in a plate, which creates eddies near the openings causing turbulence which pulls in outside air. As a container moves past the perpendicular row of high velocity jets, the jets are initially directed downward into the container at the leading edge of the container's open top. As the container moves further forward, the flushing gas is directed into the center and, later, into the trailing edge of the open top, after which the container clears the row of jets before being exposed to the next perpendicular row of jets. The process is repeated as the container passes below the next row of jets.

The apparatus disclosed in Domke is directed at flushing empty containers and, in effect, relies mainly on a dilution process to decrease oxygen levels. One perpendicular row of jets per container pitch is inadequate to efficiently remove air contained in food product.

Constantly changing jet patterns in prior art devices create turbulence above and within the containers, which can cause surrounding air to be pulled into the containers by the jets. This turbulence also imposes a limitation on the speed at which the containers pass below the jets. As the containers move faster beneath the jets, the flow patterns within the containers change faster, and the turbulence increases. Also, at high line speeds, purging gas has more difficulty going down into the containers because of the relatively shorter residence time in contact with each high velocity row. The purging gas also has a greater tendency to remain in the head space above the containers. In addition, a perpendicular arrangement of jets relative to the direction of container travel causes much of the jet to be directed outside the containers, especially when the containers are round. Moreover, the spacing apart of the perpendicular rows may further vary the flow pattern and pull outside air into the containers.

The size of the container and container opening are also factors which may prevent adequate flushing and removal of existing environment inside the container. Medical bottles or vials that may contain medical liquids or powder, such as, for example, antibiotics, may have openings of less than ½ inch. To effectively remove the existing environment from these containers, existing gassing systems, for example, as disclosed in U.S. Pat. No. 4,140,159, issued to Domke, are not adequate. It may also be impracticable to use systems with widths, which may be, for example, less than ⅙ inch.

Therefore, it would be desirable to have a gassing system that would replace the air within empty and/or filled containers of various shapes and opening widths with a controlled environment of higher purity which would greatly increase the shelf life of the product.

SUMMARY OF THE INVENTION

One aspect of the present invention provides an apparatus for exposing a container traveling along a conveyor to a controlled environment is provided. The apparatus includes an elongated rail and a first elongated gas deflecting member. The elongated rail includes a longitudinally oriented manifold. The longitudinally oriented manifold is adapted to align with a path of the container. The elongated rail also includes at least one inlet opening to receive a controlled environment gas. The first elongated gas deflecting member is positioned adjacent to the manifold. The first elongated gas deflecting member is contoured to deflect a flow of the controlled environment gas exiting the manifold in a direction transverse to the path of the container and substantially into the container.

Another aspect of the present invention provides a method of operating an apparatus for exposing a container traveling along a conveyor to a controlled environment. An elongated rail and a first elongated gas deflecting member is provided. The elongated rail includes a longitudinally oriented manifold. The container is passed along the elongated rail for a predetermined period of time. A controlled environment gas is supplied through each of the at least one inlet openings. The controlled environment gas is then passed through the manifold. Finally, the controlled environment gas is deflected from the manifold by a contour of the first elongated gas deflecting member in a direction transverse to the path of the container and substantially into the container.

Another aspect of the present invention provides a system for exposing a product contained within a container traveling on a conveyor to a controlled environment. The system includes an elongated rail and a first elongated gas deflecting member. The elongated rail includes a longitudinally oriented manifold and at least one inlet opening to receive a controlled environment gas. The longitudinally oriented manifold is adapted to align with a path of the container. The first elongated gas deflecting member is positioned adjacent to the manifold. The first elongated gas deflecting member is contoured to deflect a flow of the controlled environment gas exiting the manifold in a direction transverse to the path of the container and substantially into the container.

The foregoing and other features and advantages of the present invention will become further apparent from the following detailed description of the presently preferred embodiments, read in conjunction with the accompanying drawings. The detailed description and drawings are merely illustrative of the present invention, rather than limiting, the scope of the present invention being defined by the appended claims and equivalents thereof.

DETAILED DESCRIPTION OF THE PRESENTLY PREFERRED EMBODIMENTS

Figure 1:
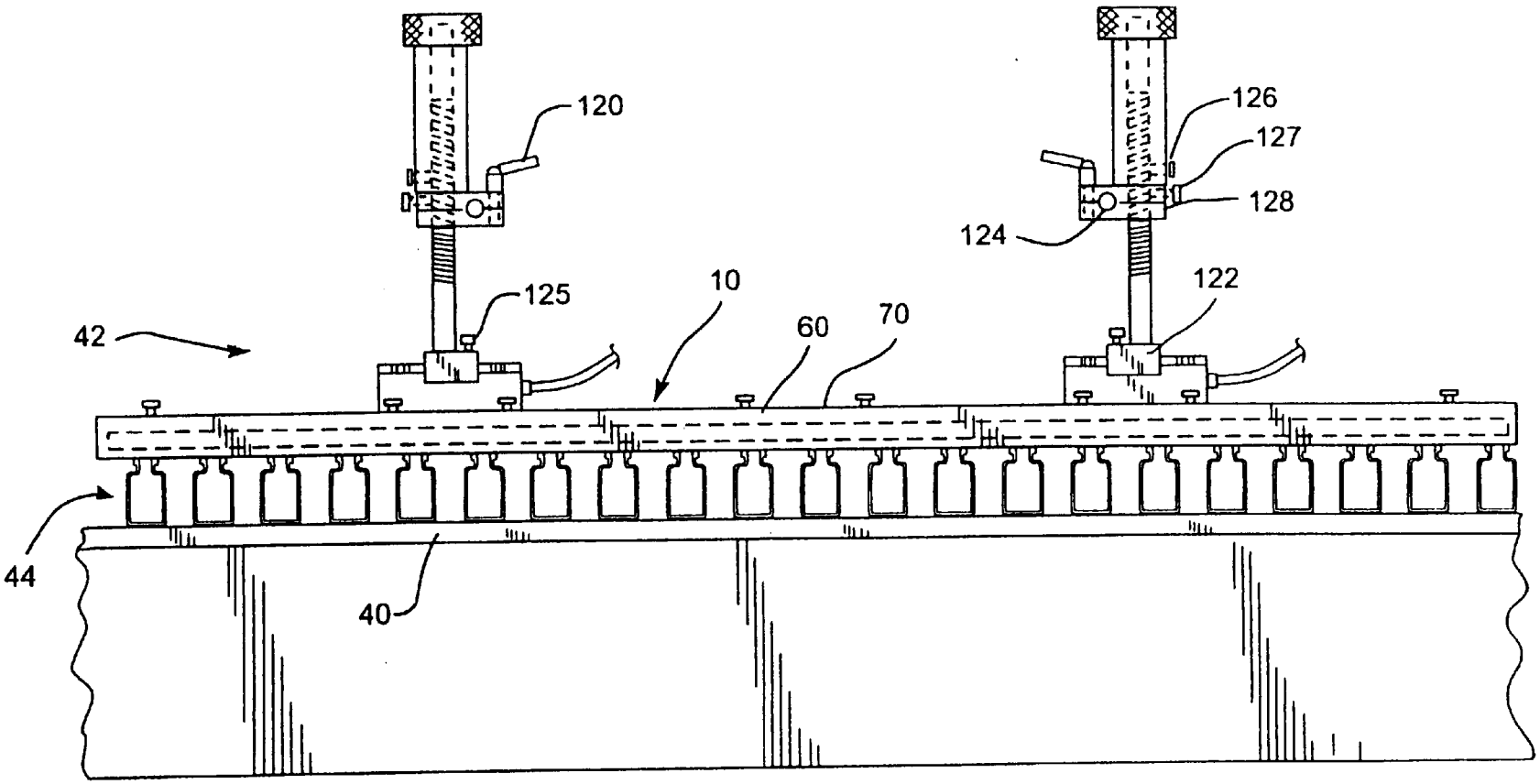
FIG. 1 is a side view of a preferred embodiment of the present invention, longitudinally disposed along a row of containers being transported by a conveyor.

Referring to FIG. 1, a preferred embodiment of the gassing rail apparatus is generally shown at numeral 7. The gassing rail apparatus generally includes an elongated rail 10. The elongated rail 10 is disposed along a row of containers 44 traveling on a conveyor 40 along the elongated rail 10 in a direction of travel designated by arrow 42.

Figure 2:
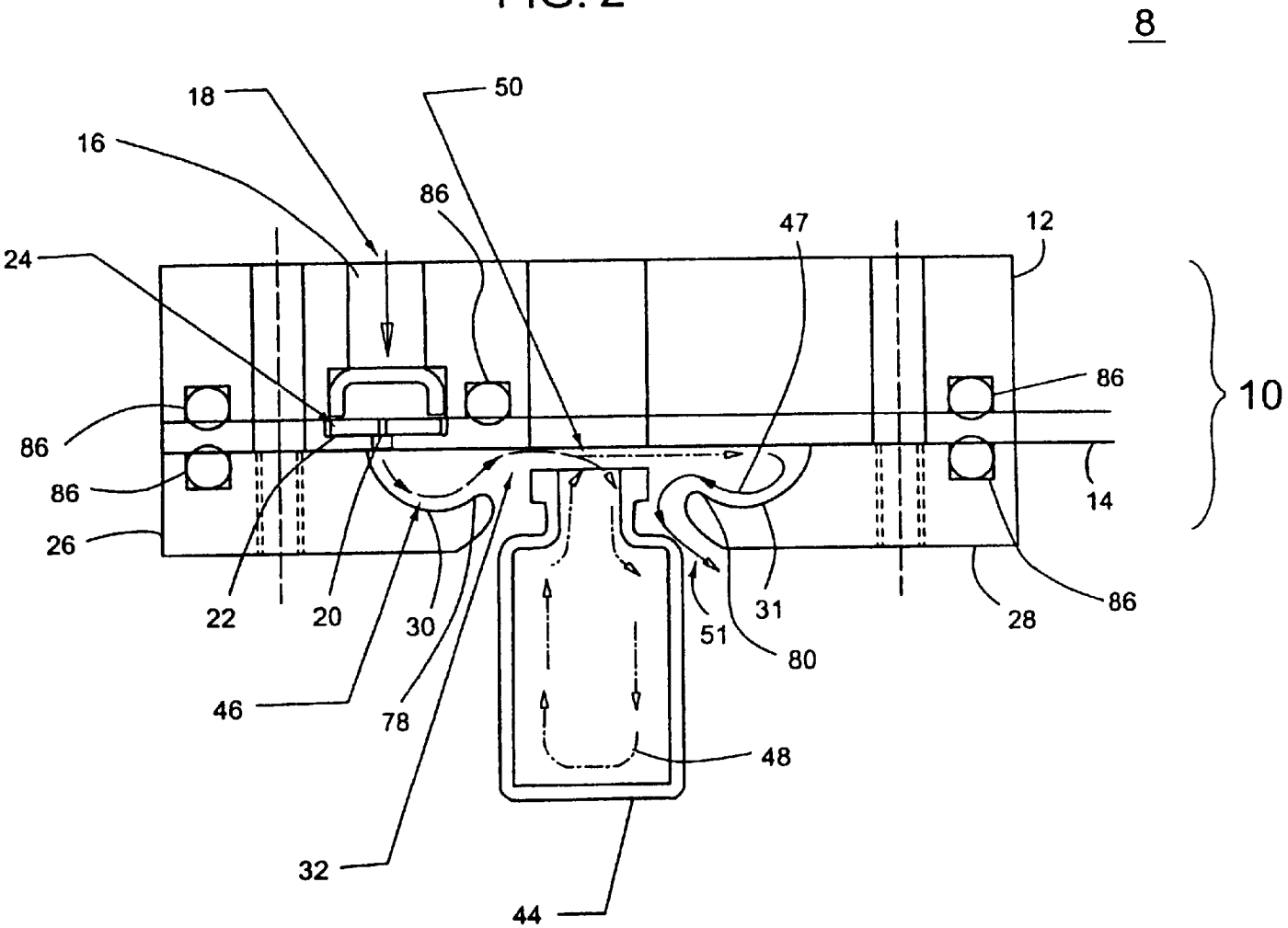
FIG. 2 is a sectional view of a preferred embodiment of a pre-purge gassing rail apparatus, made in accordance with the present invention.

Referring to FIG. 2, a preferred embodiment of a pre-purge gassing rail apparatus is generally shown at numeral 8. The gassing rail apparatus 8 includes a first deflecting member 26 and a second deflecting member 28. Each of the deflecting members 26, 28 has an arcuate shape, with an upward-turning end region 78, 80, respectively. As a result, each of the deflecting members 26, 28 are preferably shaped so as to direct the flow of a controlled environment gas from the inlet 16 through an elongated open region 32. More specifically, the first deflecting member 26 is shaped to direct the flow of the controlled environment gas (along the path shown by arrow 46) from the inlet 16 around the arcuate curve 30 and into the container 44 (substantially along the path shown by arrow 48). Next, the controlled environment gas is flushed out of the container 44 (along the path shown by arrow 50), and towards the second deflecting member 28. Finally, the second deflecting member 28 is shaped to direct the flow of the controlled environment gas (substantially along the path shown by arrow 47) around the arcuate curve 31 and eventually out of the elongated open region 32 (along the path shown by arrow 51).

Figure 4:
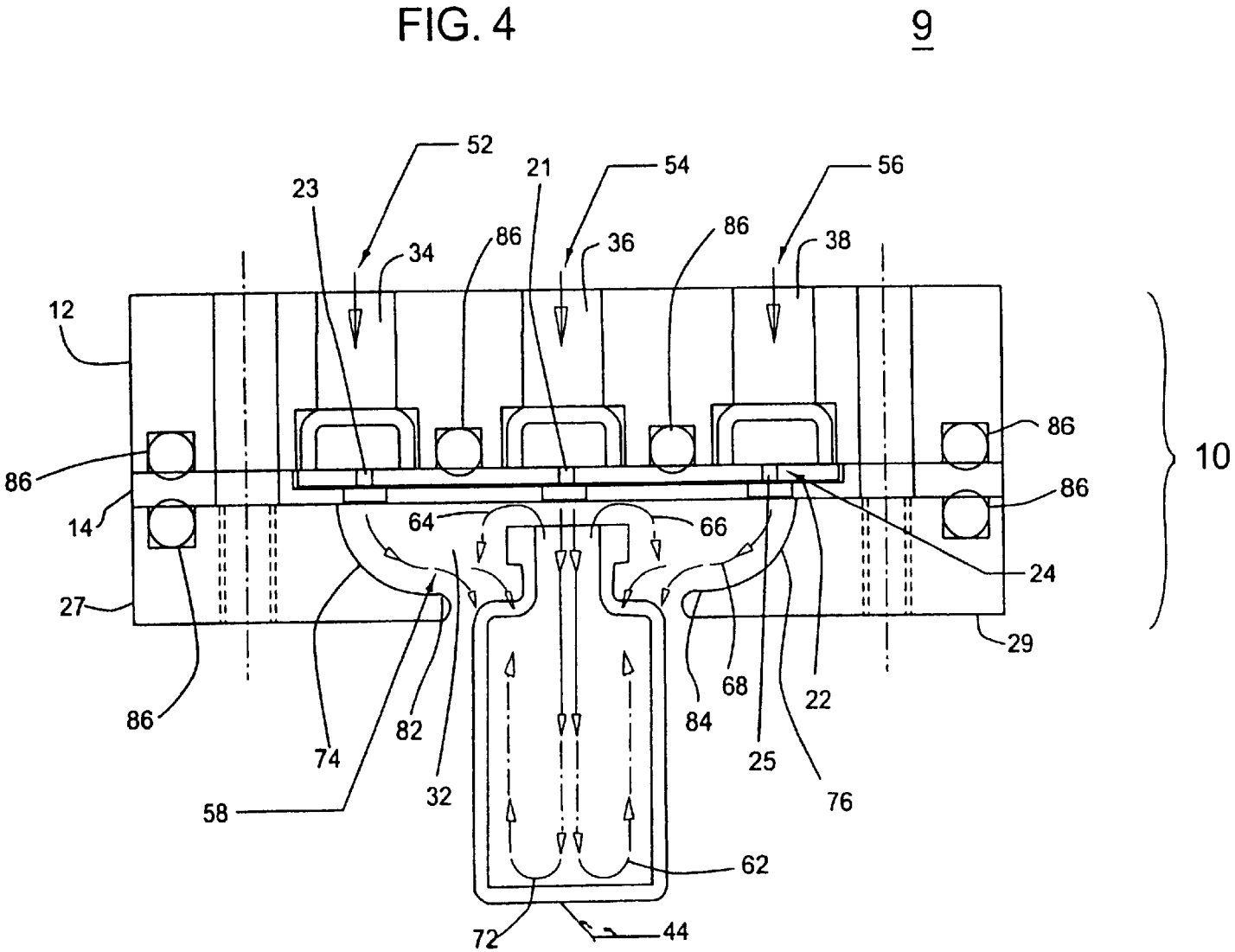
FIG. 4 is a sectional view of a preferred embodiment of a purge gassing rail apparatus, made in accordance with the present invention.

Referring to FIG. 4, a preferred embodiment of a purge gassing rail apparatus is generally shown at numeral 9. The purge gassing rail apparatus 9 also includes a first deflecting member 27 and a second deflecting member 29. Each of the deflecting members 27, 29 has an arcuate shape, with an end region 82, 84, respectively. The end regions are generally shaped in a direction perpendicular to the container 44 or parallel with an elongated rail base member 14. As a result, each of the deflecting members 27, 29 are preferably shaped so as to direct the flow of a controlled environment gas from the inlets 34, 36, 38 through the elongated open region 32. More specifically, the first deflecting member 27 is shaped to direct the flow of the controlled environment gas (along the path shown by arrow 58) from the inlet 34 around the arcuate curve 74 and out of the elongated open region 32. Similarly, the second deflecting member 29 is shaped to direct the flow of the controlled environment gas (along the path shown by arrow 68) from inlet 38 around the arcuate curve 76 and out of the elongated open region 32. Controlled environment gas from inlet 36 enters the container 44, flows throughout the container 44 (substantially along the path shown by arrows 62, 72) and eventually flows out of the container 44 (substantially along the path shown by arrows 64, 66). As a result of the air flow created by the controlled environment gas from inlets 34, 38, the controlled environment gas flowing out of the container then exits the elongated open region 32.

The elongated rail 10 may be composed of two 2 ft. sections 60, 70. Alternatively, sections of various lengths may be used and positioned in series to create the desired length of elongated rail 10. For example, elongated rail sections having a length of 3–12 inches may be combined with 2 ft. sections.

The elongated rail 10 should preferably be at least as wide, and more preferably, somewhat wider, than the opening of the container 44. The purpose for this will be described in detail below with reference to the elongated open region 32. The elongated rail 10 may also be narrower than the container 44 opening, but under certain conditions, this may allow outside air to contaminate the container 44. Structure or other means may be combined with the narrower elongated rail 10 to maintain the controlled environment. The length of the elongated rail 10 may vary depending on the desired line speed and minimum residence time underneath the elongated rail 10 for each container 44. Also, a plurality of elongated rail sections may be arranged lengthwise in series to create a greater "effective" length. The actual length or number of elongated rail sections required will depend on various factors, including conveyor speed, container and product volume, and product type. Additionally, elongated rail 10 may be controlled to follow various production guidelines (i.e., it may be curved).

Figure 3:
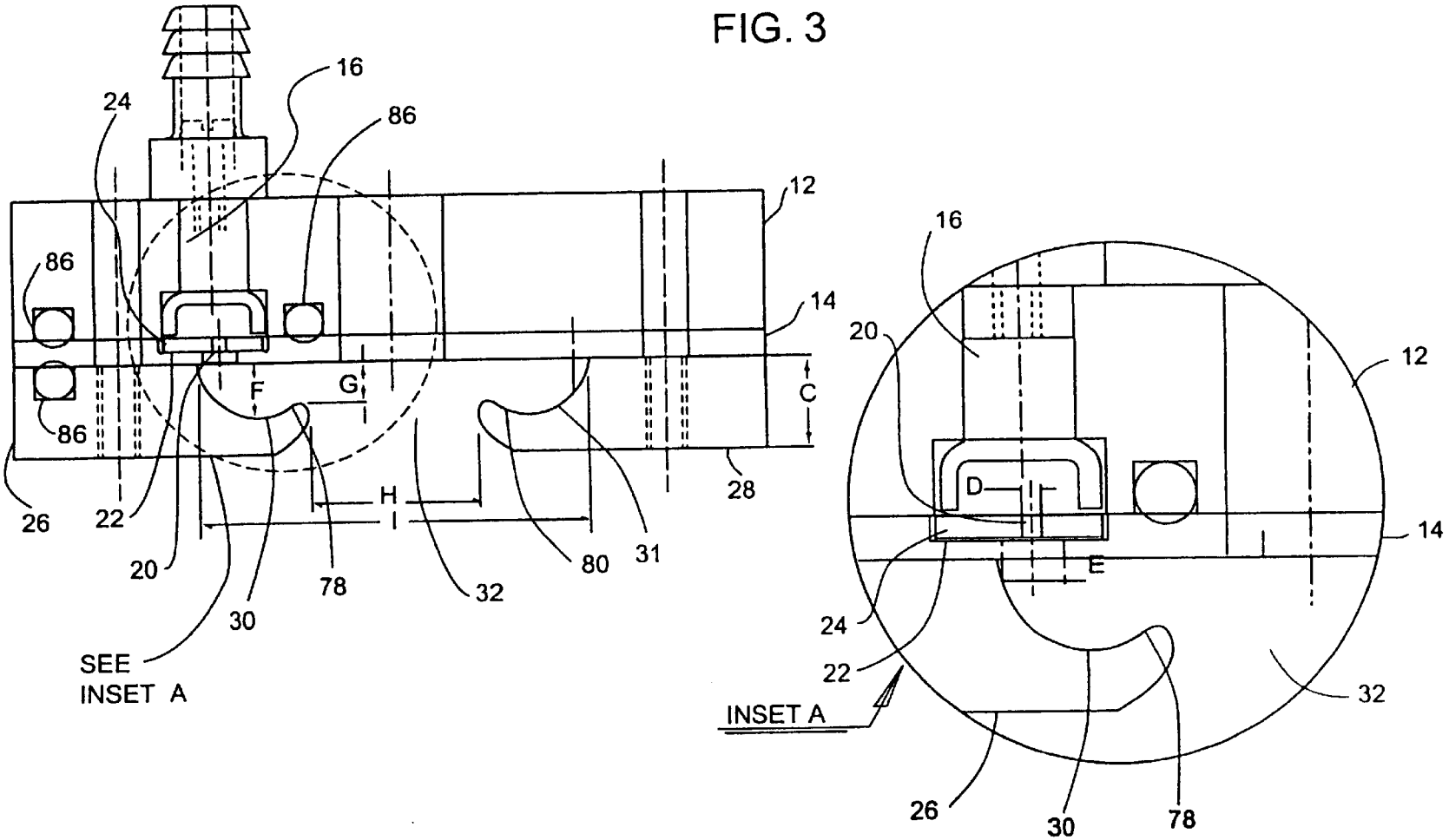
FIG. 3 is an isolated close-up view of the pre-purged gassing rail apparatus of FIG. 2.

Referring to FIGS. 2–3, the elongated rail 10 may preferably include an elongated rail top member 12 and an elongated rail base member 14. Preferably, the elongated rail top member 12 and the elongated rail base member 14 are in longitudinal communication with each other; that is, they are situated parallel with each other substantially throughout the length of the elongated rail 10 in a manner such that the elongated rail top member 12 may be located directly above the elongated rail base member 14.

Both the elongated rail base member and the elongated rail top member 12, 14 may be made of any known material capable of achieving the purposes of the present invention, such as, for example, stainless steel or plastic. Furthermore, the elongated rail top member 12 and the elongated rail base member 14 may be attached to each other by any known means, such as for example, through a screw or through a nut-and-bolt assembly. Additionally, the deflecting members 26, 27, 28, 29 may also be made of any known material capable of achieving the purposes of the present invention, such as, for example, stainless steel or plastic. The attachment of the deflecting members 26, 27, 28, 29 to the elongated rail base member 14 may be by any known means, such as, for example, through a screw or nut-and-bolt assembly. The attachment means described here may further include a plurality of o-rings 86 to ensure an airtight seal.

Although referred to herein as "elongated rail top member" and "elongated rail base member," it is contemplated that the elongated rail 10 may be inverted or positioned in various configurations where the elongated rail top member 12 is not completely disposed over the elongated rail base member 14.

Included within the elongated rail top member 12 of the elongated rail 10 is at least one gas inlet 16. In FIGS. 2–3, one gas inlet 16 is shown. However, it is contemplated that the present invention may include more than one gas inlet. In fact, FIGS. 4–5, includes a first gas inlet 34, a second gas inlet 36 and a third gas inlet 38, the purpose of which will be described in detail below. Preferably, the gas inlet 16 receives a controlled environment gas. The controlled environment gas enters the gas inlet 16 in a direction represented by arrow 18. The gas inlet 16 may force the controlled environment gas into the elongated open region 32 by a speed of, for example, 10–200 liters per minute (LPM).

Referring again to FIGS. 2–3, also included within the elongated rail 10, is a longitudinally oriented manifold 20. The longitudinally oriented manifold 20, in conjunction with gassing element 22, preferably serves to allow the outflow of the controlled environment gas from the gas inlet 16, via the direction represented by arrow 18, into the elongated open region 32.

The dual laminar screen member 24 preferably comprises the longitudinally oriented manifold 20 and gassing element 22. The dual laminar screen member 24 preferably controls the outflow of the controlled environment gas, regulating, for example, such factors as velocity and direction.

In the embodiment shown in FIGS. 2–3, the first deflecting member 26 is preferably attached to a bottom side of the elongated rail 10 at one end of the elongated rail 10. In the example illustrated, the first deflecting member 26 is attached at the left side of the elongated rail 10. The second deflecting member 28 is preferably attached to the bottom side of the elongated rail 10 at an opposing end of the elongated rail 10. In the example illustrated, the second deflecting member 28 is attached at the right side of the elongated rail 10. In conjunction, the first deflecting member 26 and the second deflecting member 28 forms the first deflecting member curve 30 and the second deflecting member curve 31, respectively.

The first deflecting member curve 30 is preferably shaped in an arcuate contour to direct the flow of the controlled environment gas exiting the manifold 20 in a direction transverse to the path of the container 44 and into the open container 44. The first deflecting member curve 30 also includes an upward-turning end region 78 which assists in directing the flow of the controlled environment gas along a path that the container 44. The second deflecting member curve 31 is preferably shaped in an arcuate contour to direct the flow of the controlled environment gas exiting the container 44 in a direction transverse to the path of the container 44 and out of the elongated open region 32. The second deflecting member curve 31 may also preferably include an upward-turning end region 80 which assists in directing the flow of the controlled environment gas exiting the container 44 through the elongated open region 32.

As shown in FIG. 3, the first deflecting member curve 30 and the second deflecting member curve 31, by their arcuately contoured shapes, forms the boundary of the elongated open region 32, in which the container 44 is positioned. The deflecting member curves 30, 31 operate to direct the controlled environment gas flow to a container 44 located within the elongated open region 32 (see arrow 46), through the container 44 (see arrow 48), away from the container 44 and the elongated rail deflecting member 30 (see arrow 50), and out of the elongated open region 32 (see arrow 51).

Referring to FIG. 3, one section of the pre-purge rail apparatus 8 may include the following preferred dimensions, although it should be noted that the apparatus may include alternative dimensions. The deflecting member curves 30, 31 are preferably 0.480 inches thick (see C). The controlled environment gas enters the elongated open region 32, through the longitudinally oriented manifold 20 (which preferably contains an opening of 0.062 inches—see D) and gassing element 22, via an opening of preferably 0.188 inches (see E). As the controlled environment gas enters the elongated open region 32, it encounters the first deflecting member 26. The first deflecting member 26 is preferably, at the most, 0.281 inches from the bottom of the elongated rail base member 14 (see F). Preferably, the upward-turning end region 78 is 0.213 inches from the bottom of the elongated rail base member 14 (see G). Preferably, the same dimensions are maintained at the second deflecting member 28. Additionally, the distance between the first deflecting member 26 and the second deflecting member 28 may be 0.844 inches at the closest point (see H) and 1.940 inches at the farthest point (see I). The pre-purge rail apparatus 8 may be made of any known material capable of achieving the purposes of the present invention, such as, for example, stainless steel or plastic.

Referring to FIG. 3, generally, the pre-purge rail apparatus 8 operates in the following manner. First, the first deflecting member 26 is positioned to receive the flow of the controlled environment gas from the manifold 20 (represented by arrow 18). The first deflecting member 26 then redirects the controlled environment gas towards an opening formed by the boundaries of the first deflecting member curve 30 and the upward-turning end region 78 (arrow 46). That is, the curve, which forms the shape of the first deflecting member 26, redirects the controlled environment gas towards the center of the elongated open region 32. Preferably, at the center of the elongated open region 32, the container 44 is located. The controlled environment gas then enters the container 44 (arrow 48) in a preferred gas profile to purge the environment within the container 44. The gas then exits the container 44 (arrow 50). Finally, the second deflecting member 28 directs the gas exiting the container 44 out of the elongated open region 32 (arrow 50). The second deflecting member does this by the boundaries of the second deflecting member curve 31 and the upward-turning end region 80.

In one embodiment, the principle directing the flow of the controlled environment gas through the elongated rail deflecting member 30 may operate according to the Coanda principle. In essence, the Coanda principle specifies that a stream of fluid or air will tend to follow the surface of a solid which is curved slightly in a direction away from the stream. The Coanda principle is further described in additional detail at www.cfcl.com/jef/coanda_effect.html, the contents of which are fully incorporated herein.

Figure 5:
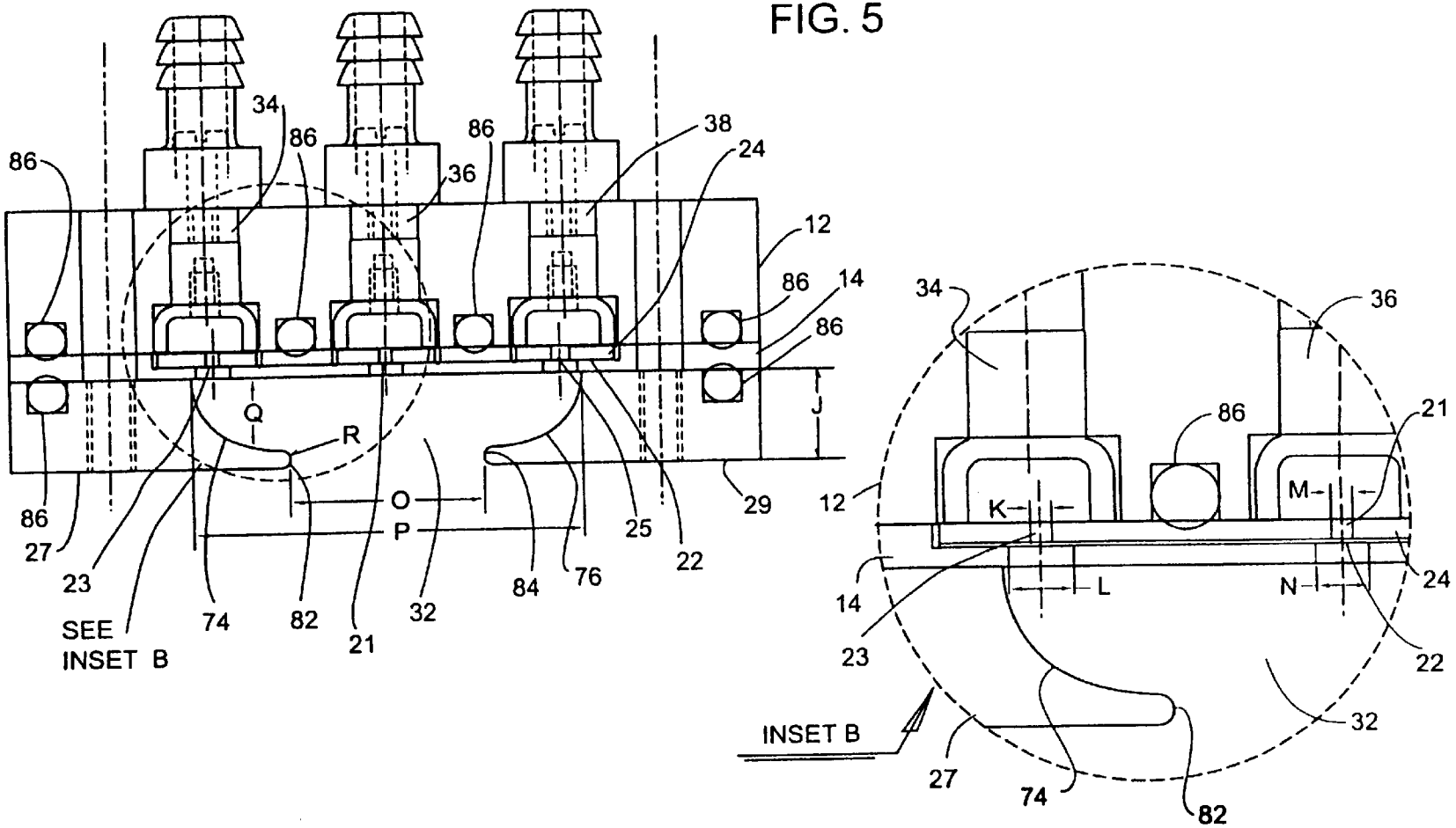
FIG. 5 is an isolated close-up view of the purge gassing rail apparatus of FIG. 4.

Referring to FIGS. 4–5, it should be noted that the illustrated preferred embodiment of the purge rail apparatus 9 is similar to the pre-purge rail apparatus 8 disclosed and discussed with regards to FIGS. 2–3. However, at least one distinct difference exists. In FIG. 4, there are a total of three gas inlets, noted by reference numerals 34, 36 and 38, respectively. The purge rail apparatus 9 may be used with a product within the containers 44, which include product. The flow of controlled environment gas directed into the container 44 is preferably at a rate that will effectively pruge the existing environment within the product-filled container 44. In one embodiment, first and third gas inlets 34, 38 may be operated at, for example, 10–40 LPM. Second gas inlet 36, which feeds the gassing rail positioned directly over the containers 44, may be operated at, for example, 30–100 LPM. Preferably, the flow rate for the second gas inlet 36 may be greater than that for the first and third gas inlets 34, 38. Additionally, the purge rail apparatus 9 includes a first manifold 21, a second manifold 23 and a third manifold 25, wherein the first manifold 21 is positioned between the second manifold 23 and the third manifold 25.

Preferably, the purge rail apparatus includes three gas inlets 34, 36, 38. However, the purge rail apparatus 9 may include two gas inlets, and still perform the method of the present invention. In such a case, the purge rail apparatus 9 would have a middle gas inlet (similar to 36) and one side inlet (either 34 or 38).

The gas is supplied to each manifold 21, 23, 25 is designated by arrows 52, 54 and 56. The controlled environment gas exiting through the second manifold 23 supplied by the first gas inlet 34 is deflected by the first deflecting member 27 as shown by arrow 58. The controlled environment gas exiting the first manifold 21 by the second gas inlet 36 enters the container 44 as shown by arrows 72 and 62, developing a pre-formed flow profile, and exits the container 44 by arrows 64 and 66. Finally, the controlled environment gas exiting the third manifold 25 supplied by the third gas inlet 38 is deflected by the second deflecting member 29 as shown by arrow 68.

Similar to the deflecting members 26, 28 of FIG. 2, the deflecting members 27, 29 include a first deflecting member curve 74 and the second deflecting member curve 76, respectively. Additionally, both the first deflecting member curve 74 and the second deflecting member curve 76 are preferably shaped in an arcuate contour to direct the airflow of the controlled environment gas. For example, in the illustration, the first deflecting member curve 74 includes an end region 82 which directs the flow of the controlled environment gas from inlet 34 out of the elongated open region 32. Similarly, in the illustration, the second deflecting member curve 76 includes an end region 84 which directs the flow of the controlled environment gas from inlet 38 out of the elongated open region 32. In contrast to the upward-turning end regions 78, 80 (which possess an upward turning shape), the end regions 82, 84 are shaped in a manner parallel to the elongated rail base member 14, to direct the flow of the controlled environment gas out of the elongated open region 32.

In the illustrated embodiment, one section of the rail apparatus 9 may include the following preferred dimensions, although it should be noted that the rail apparatus 9 may include alternative dimensions. The elongated rail deflecting member 30 is preferably 0.480 inches thick (see J). The controlled environment gas enters the elongated open region 32 (via the first and third gas inlets 34, 38) through the second and third longitudinally oriented manifolds 23, 25 (which preferably contains an opening of 0.062 inches—see K) and gassing element 22, entering the elongated open region 32 via an opening of preferably 0.188 inches (see L). The controlled environment gas enters the elongated open region 32 (via the second gas inlet 36) through the first longitudinally oriented manifold 21 (which preferably contains an opening of 0.062 inches—see M) and gassing element 22, entering the elongated open region 32 via an opening of preferably 0.156 inches (see N). The first deflecting member 27 is preferably positioned, for example, 0.375 inches from the bottom of the elongated rail base member 14 (see Q). Preferably, the end region 78 maintains a radius of 0.100 inches (see R). Preferably, the same dimensions are maintained at the second deflecting member 28. In one embodiment, the distance between the first deflecting member 27 and the second deflecting member 29 is preferably, for example, 0.979 inches at the closest point (see O) and 1.944 inches at the farthest point (see P). The purge rail apparatus 9 may be made of any known material capable of achieving the purposes of the present invention, such as, for example, stainless steel or plastic.

In operation, a preferred embodiment of a system for exposing a container 44 to a controlled environment is as follows. A container 44 is passed along the pre-purge rail apparatus 8. Preferably, the container 44 may be passed along the pre-purge rail apparatus 8 through any known means of conveyance, such as, for example, a conveyor belt. As the container 44 is being passed along the pre-purge gassing rail 8, a controlled environment gas is supplied through the manifold 20, and is deflected by the first deflecting member 26 (which includes the first deflecting member curve 30 and the upward-turning end region 78) into the container 44 (arrows 46 and 48). The controlled environment gas then circulates through the container 44 in a preferred flow profile. The gas exiting the container 44 (arrow 50) is deflected by the second deflecting member 28 (which includes the second deflecting member curve 31 and the upward-turning end region 80), out of the elongated open region 32.

The container 44, which may, at this point, include a product, is then passed along the purge rail apparatus 9. Preferably, the method of passing the container 44 along the purge rail apparatus 9 is similar to the method of passing the container 44 along the pre-purge rail apparatus 8, as described above. While the container 44 is being passed along the purge rail apparatus 9, a controlled environment gas is supplied into the elongated open region 32. The controlled environment gas is supplied into the elongated open region 32 through the three gas inlets 34, 36, 38.

Via the first gas inlet 34, the controlled environment gas is deflected towards the opening within the elongated open region 32 between the container 44 and the first deflecting member 27 (arrow 58). The gas flowing from the first manifold 21 provides a lateral shield of controlled environment gas to prevent the migration of oxygen or other contaminating environment into the elongated open region 32. In this way, the product contained within the container 44 will not be contaminated by outside air. The gassing system also provides a highly controlled flow pattern within the elongated open region 32. A Venturi effect may also be created by the flow, which drives the exhaust controlled environment gases out of the elongated open region 32. This allows the flow exiting the container 44 to be directed out of the container 44 and the elongated open region 32. Additionally, this prevents the build up of air within the elongated open region 32.

The controlled environment gas exiting the third manifold 25 is deflected through the elongated open region 32 between the container 44 and the second deflecting member 29 (arrow 68). The flow from the third gas inlet 38 is similar to that described above with regards to the flow from the first gas inlet 34. In fact, the operation of the third gas inlet 38 with the second deflecting member 29 is a mirror image of the operation of the first gas inlet 34 with the first deflecting member 27.

Referring to FIGS. 4–5, the controlled environment gas exiting the first manifold 21 enters the container 44, creating a centerline purge as shown in FIGS. 4–5 (arrows 62, 72). The controlled environment gas then circulates within the container 44, exits the container 44, and is deflected out of the elongated open region 32 (arrows 64, 66) and with the assistance of the flow from both the first and third manifolds 20 (arrows 58, 68).

Figure 6:
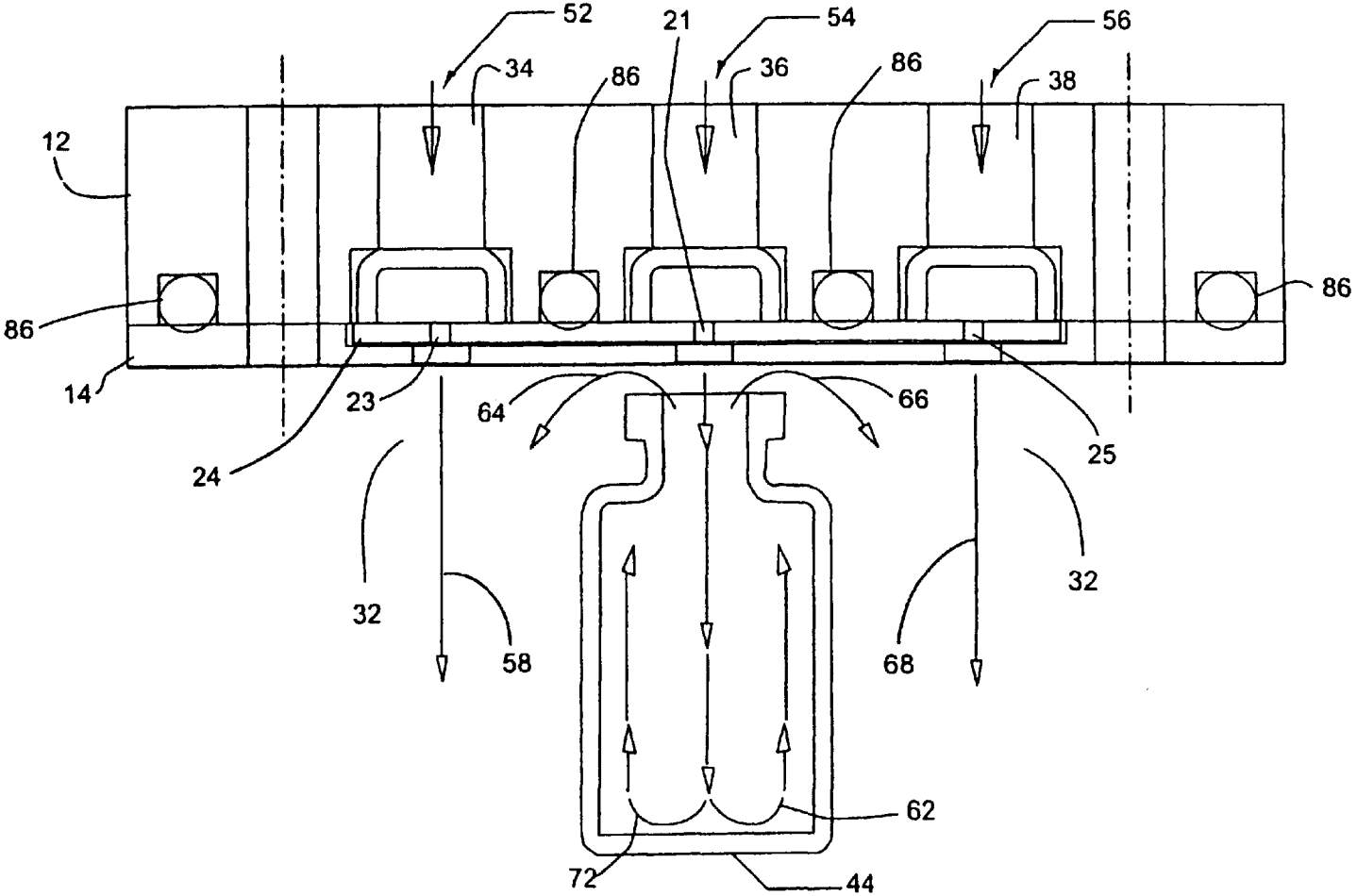
FIG. 6 is a sectional view of another preferred embodiment of a purge gassing rail apparatus, made in accordance with the present invention.

In an alternate embodiment shown at FIG. 6, the purge rail apparatus 9 may be designed and implemented without either the first or second deflecting members 27, 29. In such an embodiment, a Venturi effect may still apply to direct the flow of the controlled environment gas out of the container 44. To achieve this, the outside manifolds (i.e., the second manifold and the third manifold) 23, 25 may be positioned in a location such that the flow of controlled environment gas is substantially proximate to the edge of the container 44. As a result, the Venturi effect of the flows (arrows 58 and 68) causes the controlled environment gas exiting the container 44 (arrows 64 and 66) to exit the open elongated region 32. This embodiment may be utilized to evacuate and sterilize a large container 44 without disturbing the product contained within.

Further information regarding a gassing rail apparatus is disclosed in U.S. Pat. No. 5,911,249, entitled Gassing Rail Apparatus and Method, filed Mar. 13, 1997, the entire disclosure of which is incorporated herein.

While the embodiment of the present invention, disclosed herein, are presently considered to be preferred, various changes and modifications can be made without departing from the spirit and scope of the present invention. The scope of the present invention is indicated in the appended claims, and all changes that come within the meaning and range of equivalents are intended to be embraced therein.

We claim:

1. An apparatus for exposing a container traveling along a conveyor to a controlled environment, comprising:

an elongated rail including a longitudinally oriented manifold adapted to align with a path of the container, and at least one inlet opening to receive a controlled environment gas; and a first elongated gas deflecting member positioned beneath and adjacent to the manifold, the first elongated gas deflecting member including a curved surface to directly receive a flow of the controlled environment gas exiting the manifold and deflecting the flow in a direction transverse to the path of the container and into the container.

2. The apparatus of claim 1, further including a second elongated gas deflecting member positioned adjacent to the manifold, the second elongated gas deflecting member contoured to deflect a flow of the controlled environment gas exiting the container in a direction transverse to the path of the container and through an open elongated region.

3. The apparatus of claim 1, wherein each of the at least one inlet openings is positioned above the manifold.

4. The apparatus of claim 1, wherein the first elongated gas deflecting member includes an upward-turned end region adapted to receive the controlled environment gas and to deflect the controlled environment gas into the container.

5. The apparatus of claim 2, wherein the second elongated gas deflecting member includes an upward-turned end region adapted to receive the controlled environment gas and to deflect the controlled environment gas through the elongated open region.

6. A method of operating an apparatus for exposing a container traveling along a conveyor to a controlled environment, comprising the steps of:

providing an elongated rail, the elongated rail including a longitudinally oriented manifold, and a first elongated gas deflecting member positioned adjacent to the manifold;

passing the container along the elongated rail for a pre-determined period of time;

supplying a controlled environment gas into the manifold;

passing the controlled environment gas through the manifold; and receiving the controlled environment gas immediately exiting the manifold at the first elongated gas deflecting member and deflecting the received controlled environment gas in a direction transverse to the path of the container and into the container.

7. The method of claim 6, further comprising directing the controlled environment gas out of the container.

8. The method of claim 7, further providing a second elongated gas deflecting member positioned adjacent to the manifold; and further comprising:

deflecting the controlled environment gas exiting the container by a contour of the second elongated gas deflecting member in a direction transverse to the path of the container and through the elongated open region.

9. An apparatus for exposing a product contained within a container traveling along a conveyor to a controlled environment, comprising:

an elongated rail including first, second and third longitudinally oriented manifolds adapted to align with a path of the container, and at least one inlet opening to receive a controlled environment gas; and a first elongated gas deflecting member positioned adjacent to the second longitudinally oriented manifold, the first elongated gas deflecting member contoured to deflect a flow of the controlled environment gas exiting the second longitudinally oriented manifold in a direction transverse to the path of the container and through an elongated open region;

wherein the first longitudinally oriented manifold is positioned between the second longitudinally oriented manifold and the third longitudinally manifold.

10. The apparatus of claim 9, further including a second elongated gas deflecting member positioned adjacent to the third longitudinally oriented manifold, the second elongated gas deflecting member contoured to deflect a flow of the controlled environment gas exiting the third longitudinally oriented manifold in a direction transverse to the path of the container and through the open elongated region.

11. The apparatus of claim 9, wherein the first inlet opening is positioned above the first longitudinally oriented manifold, the second inlet opening is positioned above the second longitudinally oriented manifold and the third inlet opening is positioned above the third longitudinally oriented manifold.

12. The apparatus of claim 9, wherein the first elongated gas deflecting member includes an end region adapted to receive a portion of the controlled environment gas and to deflect the controlled environment gas through an elongated open region.

13. The apparatus of claim 10, wherein the second elongated gas deflecting member includes an end region adapted to receive a portion of the controlled environment gas and to deflect the controlled environment gas through an elongated open region.

14. The apparatus of claim 9, wherein the first longitudinally oriented manifold is adapted to receive a first portion of the controlled environment gas at a first flow rate.

15. The apparatus of claim 14, wherein the second longitudinally oriented manifold is adapted to receive a second portion of the controlled environment gas at a second flow rate, and the third longitudinally oriented manifold is adapted to receive a third portion of the controlled environment gas at a third flow rate.

16. A method for exposing a product contained within a container traveling along a conveyor to a controlled environment, comprising:

providing an elongated rail, the elongated rail including first, second and third longitudinally oriented manifolds, and a first elongated gas deflecting member positioned adjacent to the second longitudinally oriented manifold;

passing the container along the elongated rail for a predetermined period of time;

supplying a controlled environment gas through at least one inlet opening;

passing the controlled environment gas through the first, second and third longitudinally oriented manifolds; and deflecting a first portion of the controlled environment gas from the second longitudinally oriented manifold by a contour of the first elongated gas deflecting member in a direction transverse to the path of the container and through an elongated open region.

17. The method of claim 16, further providing a second elongated gas deflecting member positioned adjacent to the third longitudinally oriented manifold; and further comprising:

deflecting a second portion of the controlled environment gas from the third longitudinally oriented manifold by a contour of the second elongated gas deflecting member in a direction transverse to the path of the container and through the elongated open region.

18. The method of claim 17, further comprising directing a third portion of the controlled environment gas into the container.

19. The method of claim 18, further comprising directing the third portion of the controlled environment gas out of the container.

20. The method of claim 19, further comprising directing the third portion of the controlled environment gas through the elongated open region.

21. An apparatus for exposing a container traveling along a conveyor to a controlled environment, comprising:

an elongated rail including a longitudinally oriented manifold adapted to align with a path of the container, and at least one inlet opening to receive a controlled environment gas;

a first elongated gas deflecting member positioned adjacent to the manifold, the first elongated gas deflecting member contoured to deflect a flow of the controlled environment gas exiting the manifold in a direction transverse to the path of the container and into the container; and wherein the first elongated gas deflecting member includes an upward-turned end region adapted to receive the controlled environment gas and to deflect the controlled environment gas into the container.

22. An apparatus for exposing a container traveling along a conveyor to a controlled environment, comprising:

an elongated rail including a longitudinally oriented manifold adapted to align with a path of the container, and at least one inlet opening to receive a controlled environment gas;

a first elongated gas deflecting member positioned adjacent to the manifold, the first elongated gas deflecting member contoured to deflect a flow of the controlled environment gas exiting the manifold in a direction transverse to the path of the container and into the container;

a second elongated gas deflecting member positioned adjacent to the manifold, the second elongated gas deflecting member contoured to deflect a flow of the controlled environment gas exiting the container in a direction transverse to the path of the container and through an open elongated region; and wherein the second elongated gas deflecting member includes an upward-turned end region adapted to receive the controlled environment gas and to deflect the controlled environment gas through the elongated open region.

* * * * *